United States Patent [19]

Haven et al.

[11] Patent Number: 4,584,815

[45] Date of Patent: Apr. 29, 1986

[54] FLANGE HANGER

[75] Inventors: Joseph S. Haven, Hopkinton; Gary W. Blanchard, Newton, both of Mass.

[73] Assignee: Hambro Structural Systems Ltd., Ottawa, Canada

[21] Appl. No.: 665,155

[22] Filed: Oct. 26, 1984

[51] Int. Cl.[4] ..... E04C 3/293; E04C 3/16

[52] U.S. Cl. ..... 52/327; 52/690; 52/721

[58] Field of Search ..... 52/720, 721, 690, 326, 52/327, 328, 350, 355

[56] References Cited

U.S. PATENT DOCUMENTS

| | | | |
|---|---|---|---|
| 766,609 | 8/1904 | Fenn | 52/327 |
| 1,772,358 | 8/1930 | McIntyre | 52/690 |
| 3,527,007 | 9/1970 | McManus | 52/327 |
| 3,845,594 | 11/1974 | Butts et al. | 52/690 |
| 3,945,168 | 3/1976 | Butts et al. | 52/720 |
| 4,015,396 | 4/1977 | Butts et al. | 52/690 |

OTHER PUBLICATIONS

Hambro Erection Manual, Nov. 1983, Canada.

*Primary Examiner*—J. Karl Bell

*Attorney, Agent, or Firm*—Cushman, Darby & Cushman

[57] ABSTRACT

A flange hanger adapted for use in conjunction with a steel frame building for connecting spanner bars used in the "HAMBRO" floor system is formed with an elongated shape having a first flange for welding to a steel frame member of the building and a second flange adapted to depend vertically from the welded flange. The second flange is provided with a plurality of horizontally elongated slots to receive the ends of spanner bars and provide horizontal and vertical support therefor.

7 Claims, 5 Drawing Figures

FLANGE HANGER

CROSS REFERENCE TO RELATED APPLICATIONS

The present invention relates to a flange hanger usable with "HAMBRO" floor systems as disclosed and claimed in Butts et al, U.S. Pat. No. 3,845,594 of Nov. 5, 1974, and is intended for use in conjunction with reusable spanner bars as disclosed and claimed in Butts et al U.S. Pat. No. 3,945,168 of Mar. 23, 1976. The flange hanger of the present invention may also be used with the double top chord composite floor joist disclosed in Laurus et al, U.S. application Ser. No. 522,734 of Aug. 12, 1983. The flange hanger of the present invention is also disclosed in the Erection Manual for the Hambro D500 Composite Floor System published by the Canam Manac Group November 1983.

BACKGROUND OF THE INVENTION

The Hambro D500 Composite Floor System as disclosed in U.S. Pat. No. 3,845,594 and U.S. Pat. No. 3,945,168 was originally conceived as a floor system for use in masonry walled buildings in which the end shoes of the floor joists were supported on load bearing masonry. In such structures where a joist was parallel to a load bearing masonry wall, it was possible to bridge between the wall and the joist using a wooden spanning member supported on a wooden ledger in turn supported by a post. Such an arrangement, as will be appreciated, is awkward and time and material consuming compared to the use of reusable spanner bars between the remaining joists of the composite floor system.

The use of the "HAMBRO" Composite Floor System in steel framed buildings has recently increased, and a particularly useful application of the "HAMBRO" system is in conjunction with the double top chord sheet steel joist disclosed in U.S. application Ser. No. 522,734 filed Aug. 12, 1983, as an in-fill floor system between the frame members of a steel frame building. Whenever a "HAMBRO" joist runs parallel to a steel beam or frame member of a steel frame building the problem exists of providing an adequate connection between the joist and the frame member. Such connection should preferably be made utilizing the present system of spanner bars for connection between the joist and the steel frame member. The use of such spanner bars greatly simplifies the erection of the building both in terms of material and time.

In accordance with the present invention, it is now possible to utilize presently existing spanner bars to connect a "HAMBRO" joist system to a steel building frame. Such a connection is achieved using the applicant's novel flange hanger. Such a flange hanger permits the connection of the spanner bar to the steel building frame member and comprises an elongated shape having a first flange for welding to the building frame member and a second flange intended to be positioned vertically from the first flange when the first flange is welded to the member. The second flange is provided with a plurality of uniformly spaced horizontally elongated slots adapted to receive the end of a spanner bar to provide support therefor. The use of such a flange hanger which may be tack welded to the building frame provides support for the spanner bar and adjacent the building frame, and additionally rests both horizontal and vertical forces applied to the spanner bar during the erection phase of the "HAMBRO" floor system. The spanner bars may be inserted and removed from the flange hanger in the same manner as such insertion and removal is effected with regard to the top chord of the "HAMBRO" joist, as taught by the patents aforesaid, and may of course also be used with the telescopic roll bars of the type illustrated in the "Erection Manual for the D500 Composite Floor System".

BRIEF DESCRIPTION OF THE SEVERAL VIEWS OF THE DRAWINGS

Referring to FIG. 1, there is shown a "HAMBRO" joist 10 paralleling a masonry wall 11 with a spanner bar 12 supporting a plywood form 13. The right-hand end of the spanner bar 12 is shown engaged in the top chord of the joist 10, and the left-hand end of the spanner bar 12 is shown supported upon a 2×4 ledger 14 held in place by a 2×4 post 15.

In FIG. 2, a joist 10 is shown positioned parallel to a steel building frame member 16 with a roll bar 12 engaging the top chord of the joist 10 and a flange hanger 17 tack welded to the steel beam 16. As illustrated in FIG. 3, the beam 16 now serves to support the spanner bar 12 through the mechanism of the flange hanger 17 tack welded thereto and provides support for both horizontal and vertical loads on the spanner bar 12. Since the spanner bar is seated within the slots 18 provided in the flange hanger 17, the spanner bar 12 is held against horizontal motion by the edges of the slots 18, and against vertical motion also by resting on the bottom edge of the slots 18. The prior art support of FIG. 1 cannot, of course, provide restraint for horizontal forces.

FIG. 4 illustrates in cross-section a typical flange hanger 17 of the present invention. The flange hanger 17 is formed of a horizontal leg 19 and a vertical leg 20. The vertical leg 20 as more clearly shown in FIG. 5 contains a series of horizontally elongated openings 18 through which spanner bars may be inserted and fastened to the flange hanger 17. The openings 18 are provided at regular intervals, corresponding to the spacing of openings in the top chord of the "HAMBRO" joists. As illustrated in FIGS. 4 and 5, the flange hanger may typically be made from 55 ksi steel, 18 gauge in thickness, which is cut into strips $4\frac{1}{2}$ inches wide, punched with the openings 18 on 7 inch centers similar to the "HAMBRO" top chord, and then bent to form a flange hanger having a top flange 19, $1\frac{1}{2}$ inches wide and a vertical flange 20, 3 inches wide.

Figure 1:
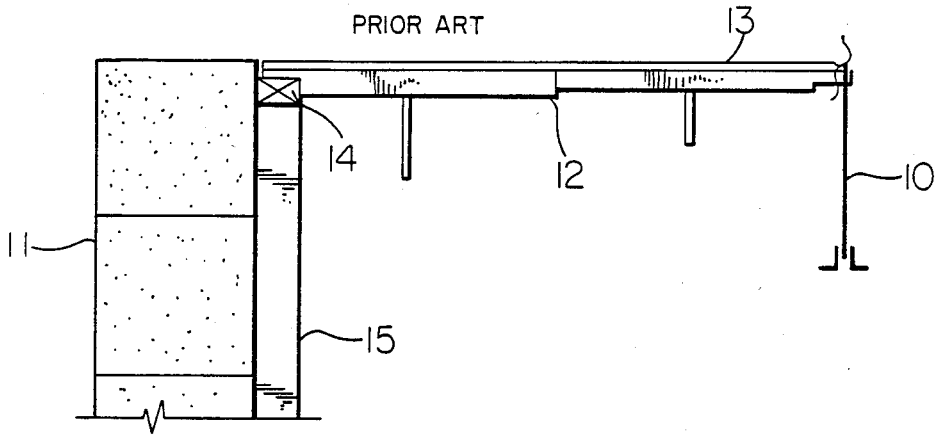
FIG. 1 PRIOR ART
FIG. 1 is a section through a prior art "HAMBRO" floor system in which the floor system is supported on masonry walls and in which the spanner bar adjacent a masonry wall in supported on a wooden support structure.
Figure 2:
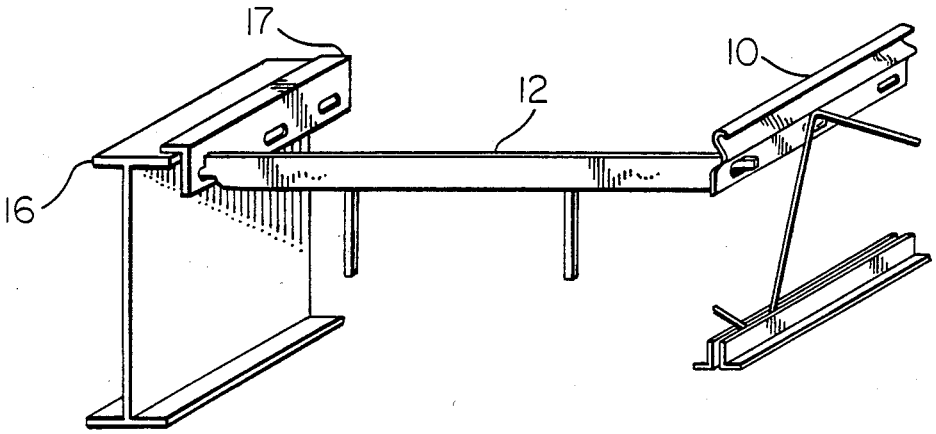
FIG. 2 is a diagram broken away and partly in perspective illustrating the use of the flange hanger of the present invention.
Figure 3:
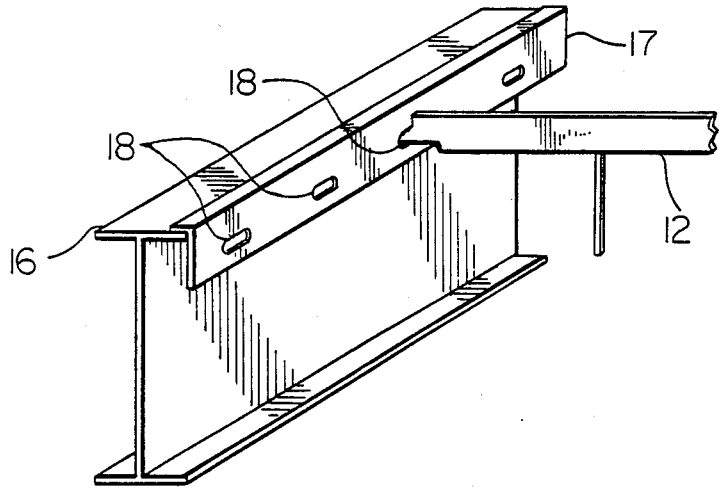
FIG. 3 is another perspective view of the flange hanger of the invention in use.
Figure 4:
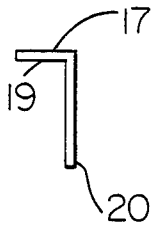
FIG. 4 is a cross-section of one form of flange hanger.
Figure 5:
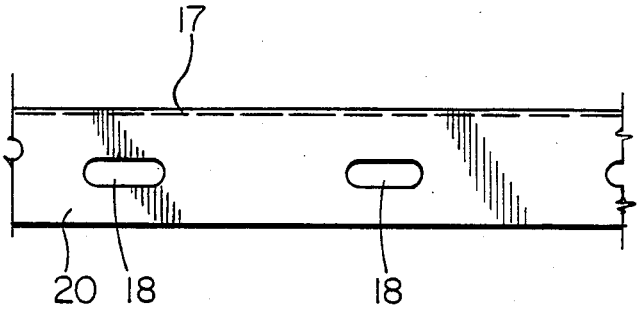
FIG. 5 is a side view of the flange hanger of FIG. 4.

In use, the $1\frac{1}{2}$ inch horizontal flange or leg 19 is tack welded to the top flange of a beam running parallel to a "HAMBRO" joist. The slots 18 are then in a position to accommodate spanner bars similar to the manner in which the bars are accommodated by the "HAMBRO" joist. The flange hanger allows the use of standard roll bars and eliminates the need for wood blocking between the beam flanges which was the only previous way of supporting spanner bars and formwork.

The actual dimensions of the flange hanger may, when required, be varied to a suit special job site conditions. Although the flange hanger is generally used on a wide flange beams that run parallel to "HAMBRO" joists, it may also be used on any structural members such as a standard joist, long span joist or joist girder.

Conveniently, the flange hanger is manufactured in 20 foot lengths which may then be cut as necessary on site to meet the requirements of a specific installation.

I claim:

1. In a system for the erection of composite steel and concrete floors of the type wherein a plurality of steel joists are arranged in parallel and connected during erection by removable spanner bars positioned in slots formed in the top chord portion of said joists, the improvement comprising:

means for supporting one end of a spanner bar adjacent a steel building frame member having a steel top flange, said means including a horizontally elongated flange hanger welded to said top flange, said flange hanger having a first leg for welding to said building frame member and a substantially flat second downwardly depending leg, said downwardly depending leg being provided with a plurality of horizontally elongated slots disposed horizontally of each other and being adapted to receive one end of a plurality of spanner bars, said flange hanger being welded as aforesaid to said steel top flange for providing a means for transmitting horizontal and vertical forces from said spanner bars to said building frame during building construction and for permitting removal of said spanner bars when said concrete as been poured and set and said spanner bars are no longer required.

2. A flange hanger as in claim 1 wherein said steel building frame member is an I-beam.

3. A flange hanger for connecting spanner bars to a steel building flange member having a steel top flange, comprising:

horizontally elongated shape having a first flange for welding to said top flange, and a second flange depending vertically from said first flange when said first flange is welded to said member, said second flange having a plurality of horizontally uniformly spaced horizontally elongated slots adapted to receive the ends of spanner bars to provide support therefor.

4. A flange hanger as claimed in claim 3, wherein said first flange and said second flange are connected substantially at right angles.

5. A flange hanger as claimed in claim 4, wherein said first and second flanges are formed from a single strip of steel.

6. A flange hanger as claimed in claim 5, wherein said strip is 18 gauge, and said slots are punched before said strip is bent to form said flanges.

7. A method of making a flange hanger having a first flange adapted for welding to a building frame member and a second flange having a regularly spaced plurality of horizontally elongated holes, comprising forming an elongated strip of sheet steel to have a width equal to the sum of the widths of said first and second flanges, punching said slots in said strip at horizontally spaced positions, and bending said strip longitudinally to form said first and second flanges substantially at right angles to each other.

* * * * *